US006640932B1

(12) United States Patent
Weatherall

(10) Patent No.: US 6,640,932 B1
(45) Date of Patent: Nov. 4, 2003

(54) LADDER STILE EXTENDER

(76) Inventor: Barrie Weatherall, 1 Fairfax Street, Bishophill, York Y01 6EB (GB)

( * ) Notice: Subject to any disclaimer, the term of this patent is extended or adjusted under 35 U.S.C. 154(b) by 0 days.

(21) Appl. No.: 10/049,072

(22) PCT Filed: Aug. 29, 2000

(86) PCT No.: PCT/GB00/03278

§ 371 (c)(1),
(2), (4) Date: Feb. 4, 2002

(87) PCT Pub. No.: WO01/18348

PCT Pub. Date: Mar. 15, 2001

(30) Foreign Application Priority Data

Sep. 3, 1999 (GB) ..... 9920698
Mar. 14, 2000 (GB) ..... 0005944

(51) Int. Cl.[7] ..... E06C 7/00
(52) U.S. Cl. ..... 182/204; 182/201; 182/108
(58) Field of Search ..... 182/204, 205, 182/108, 200, 201

(56) References Cited

U.S. PATENT DOCUMENTS 971,997 A * 10/1910 Henning ..... 182/205
1,329,740 A * 2/1920 Barron ..... 182/205
1,729,033 A * 9/1929 Czischke ..... 182/205
2,147,052 A 2/1939 Noone
4,014,406 A 3/1977 Easton
5,148,892 A 9/1992 Lu
5,678,656 A * 10/1997 Lanzafame ..... 182/205
6,401,866 B1 * 6/2002 Roy ..... 182/204

FOREIGN PATENT DOCUMENTS

| | | |
|---|---|---|
| GB | 621.959 | 4/1949 |
| GB | 736400 | 9/1955 |
| GB | 901224 | 7/1962 |
| GB | 1354593 | 5/1974 |
| GB | 2 350 643 A | 4/2000 |

* cited by examiner

*Primary Examiner*—Alvin Chin-Shue
(74) *Attorney, Agent, or Firm*—Rodman & Rodman

(57) ABSTRACT

A ladder stile extender comprises two elongated members (20, 25; 50, 53; 80, 85) one of which is slidable within the other and having means for securing one of the members (20; 50; 80) to a ladder stile and the other of the members (25; 53; 85) functioning as a stile extender or having means to secure it to a stile extension, a set of generally parallel irregularities (23, 24; 52, 59; 83, 84, 91, 90) associated with each of the members for interengagement with those on the other member, means (27, 29; 56, 57; 88, 89) for moving the two sets of irregularities into and out of engagement with each other, and locking means (29; 62; 92) to secure the members together with the sets of irregularities so engaged.

12 Claims, 9 Drawing Sheets

LADDER STILE EXTENDER

The present invention is a stile extender for use with a ladder to enable the effective length of one or both of the stiles of the ladder to be extended and thereby to enable the ladder to be used more safely upon a surface which is inclined in a direction parallel to the plane of the ladder.

The stability of a ladder which is leaned against a wall, for example, may be seriously jeopardised if the ground surface supporting the ladder slopes in a direction parallel to the wall. With that problem in mind, it was suggested in UK Patent Specification No 1578143, which was published in 1980, that the effective length of a ladder stile might be increased by securing to it a device described therein. That device took the form of a housing rigidly attached to the ladder stile, a second element slidable longitudinally within that housing, a longitudinal slot in the housing and a locating member which was a feature of the second element and ran in the slot; the slot had transverse recesses into which the locating member could fit to prevent linear movement of the second element within the housing.

While the device described in the above-mentioned patent specification would appear to be potentially suitable for the purpose described, it exhibits two disadvantages in practice. First of all, the transverse recesses by their very nature must be spaced apart by sufficient intervals to give integrity to the structure of the housing, which of course must bear the weight of the support ladder and its user. Thus the adjustment of the length of the ladder stile is essentially a step-wise adjustment with no capacity for close setting of the stile length. Secondly, the necessary design of the device inevitably makes the product relatively expensive to produce and may as a result discourage a potential user from purchasing what could otherwise be an advantageous aid to ladder safety.

An alternative form of what is identified as a "ladder levelling device" is described in International Specification No WO 99/25947, which was published some eighteen years after the above-mentioned UK specification. The device described in that international specification is of a much more complicated design than the earlier device. Although it is suggested in Specification No WO 99/25947 that the device described therein may be either mounted within a ladder stile or attached to the side of a ladder, in fact the only specific device described is one for fitting within a stile. That device is shown to be a close fit within a ladder stile, to the extent that each different ladder stile dimension would require a different size of the stile extender. The device there described and illustrated has a large number of parts and is of such apparent length that, if fitted as illustrated within the stile of any conventional ladder, it would appear to require the lowermost ladder tread to be located unduly and inconveniently high above ground level. The complexity of the design is well illustrated by FIGS. 1 and 2 and in particular by the cross-sectional views 1—1 to 9—9 inclusive.

Because a ladder stile extender is in most situations an optional fitting of which the prime function is to enhance ladder safety in certain specific conditions, the adoption of such a device has been in general slow in practice. What the potential user appears to require is a relatively simple device which is consequently relatively cheap to purchase and install. Of course the device must nonetheless be very reliable in use and should reduce or avoid the foregoing disadvantageous features of the above-described prior proposed devices. It is an object of the present invention to provide such a device.

The ladder stile extender according to the present invention comprises two elongated members one of which is slidable within the other and having means for securing one of said members to a ladder stile and the other of the said members functioning as a stile extender or having means to secure it to a stile extension, a set of generally parallel irregularities associated with each of said members for interengagement with those on the other member, means for moving the two sets of irregularities into and out of engagement with each other, and locking means to secure said members together with said sets of irregularities so engaged. It is particularly preferred that the two sets of irregularities be each a set of generally parallel teeth, in particular such teeth extending transverse to the direction of relative movement of the two members.

It is a very important advantage of the ladder stile extender according to the present invention that it is adapted for production in a very simple and relatively inexpensive form, for use internally but more preferably externally upon ladder stiles of a wide range of cross-sectional dimensions, with a high degree of security against ladder collapse, which combination of features is not shown by any of such stile extenders as may be currently available and in use. Moreover, the design of the present novel stile extender enables the relative linear movement of the two interengaging members to be rendered continuous or nearly so, thereby enabling the extending of the relevant stile to be more readily matched to that required than has hitherto been possible.

In general it is preferred that the outer elongated member be secured to the ladder stile and that the inner such member be the one which, in the extended condition of the ladder stile extender, engages the ground either directly or via an appropriate foot or via a ground-engaging ladder base support. As indicated, the stile extender may be fitted within a ladder stile if desired. However if that is the desired arrangement then it is necessary for the extender to be of such a dimension as will allow it to fit within the ladder stile—and indeed it may even then be necessary for the extender to be of different external dimensions for each ladder size. It is a particularly preferred feature and specific advantage of the stile extender according to the present invention that it may be secured to the external surface of the ladder stile. If secured to the external surface in this way, the stile extender may be secured either to the outwardly-facing surface of the stile or to that stile surface which faces the other stile of the ladder. The design of the stile extender is such that it may be of such a size as will fit below the lowermost rung of the ladder with that rung at the conventional level, for example of the order of 6 or 7 inches (15.24 to 17.78 cm) above the ground.

The two mutually slidable members are particularly preferably of rectangular, including square, cross-section. The attachment of one of said members to the ladder stile may readily be achieved by means of bolts, preferably two said bolts, extendable from the adjacent face of the member through corresponding bores in the ladder stile. Other forms of attachment may be adopted, in particular when it is desired or necessary to avoid penetrating the stile.

The second member is preferably of a matching cross-sectional shape to that of the hollow interior of the first member and is particularly preferably a close sliding fit within that first member. Thus it is particularly preferred that it also be of rectangular, including square, cross-section. The linear dimensions of the two members are a matter of design choice but the maximum extent of their linear relative movement determines the amount by which the ladder stile may be extended.

The two sets of generally parallel irregularities, which for the sake of convenience will be hereinafter referred to as teeth, may cover a similar area in each case but that is not necessary. Preferably, one set of teeth extends, in the direction of relative movement of the relatively slidable members for a shorter distance than the other set, that is there are fewer such teeth. The fewer teeth are preferably, but not necessarily, those associated with the movable said member. The teeth themselves may if desired each be inclined towards the teeth on the other member in a direction to give enhanced resistance to undesired relative movement of the two members. The total area of interengagement of the two sets of teeth may be selected to reflect the nature of the duties for which the ladder itself is likely to be adopted but it is preferred that that area be at least 6 sq. cms. The teeth may, if desired, be formed by pressing but it is particularly preferred that they be formed by cutting into an initially planar surface or by extrusion.

When the length by which the relevant ladder stile is extended is to be adjusted, the two sets of teeth are brought out of and into engagement with each other. To this end, one of the two members must be moved away from and towards the other member, thereby allowing linear relative movement of the two members. By way of example, the two members may be interconnected by means of threaded bolts, enabling the teeth to move linearly apart. However, in a preferred form of the invention, the two sets of teeth are brought into and out of engagement with each other by relative pivoting of the two sets. The set of teeth which actually pivots is much preferably that set of fewer teeth which, as indicated above, is preferably that on the movable member. It is particularly preferred that the two sets of teeth be urged together by spring means, in particular a strong said spring, in the absence of any pressure applied, for example by the user, to urge them apart, thereby allowing the user's hands to be free to level the ladder. Thus in a particularly preferred form of the ladder stile extender according to the present invention, a relatively shorter movable member carrying a relatively smaller number of transverse teeth is pivoted relative to the longer member having a larger number of such teeth and is urged into a position wherein the two sets of teeth are interengaged by means of a spring.

When the two sets of teeth are interengaged, the two relatively movable elongated members are duly secured together by means of the locking means. That locking means may take any desired form but in one preferred form it is a threaded bolt or a nut or wing-nut threaded upon a threaded bolt; in another particularly preferred form, the two relatively movable members are secured together or released, in a very convenient manner, by means of a cam-lock.

Thus, in one preferred form of the stile extender according to the present invention, the first elongated member is secured to the ladder stile and has a number of transverse teeth across its length. The second elongated member is slidable within the first such member and carries a smaller number of such transverse teeth associated with it upon a component pivoted upon the second elongated member so as to permit the two sets of teeth to engage and disengage. The two sets of teeth are urged into mutual engagement by a spring and retained in their mutually engaged position by means of a threaded bolt and/or nut or by means of a cam-lock.

The device according to the present invention thus enables one of the elongated members to be moved into direct or indirect engagement with the adjacent ground surface and to be retained securely and safely in that position. In this way the ladder stile is effectively extended into engagement with the ground. If desired, two such stile extenders may be used, one attached to each of the stiles of the ladder. The stile extender or extenders is preferably so designed, and preferably so mounted upon the associated ladder stile, that it may be retracted beyond the lower edge of the stile when not required to be used.

Preferably the lower end of the slidable elongated member is specifically adapted for stable engagement with the adjacent ground surface or with a ladder base stabiliser of the type designed to prevent slippage of the ladder in a direction away from a wall. For example, the elongated member which extends downwardly may advantageously carry a ground-engaging foot, which preferably is pivoted upon the lower end of that member. The foot may advantageously be part-spherical, for example, hemispherical, in shape, with a generally flat ground-engaging lower surface, preferably of enhanced frictional characteristics, able, by virtue of its mounting, to lie flush with the ground surface whatever the inclination of the ladder stile.

While the ladder stile extender according to the present invention may be used alone to adapt a ladder foot to an inclination of the ground in a direction parallel to the plane of a ladder, the extender may particularly advantageously be used with a ladder brace devised to stabilise a ladder foot against slippage in a direction away from a wall against which the ladder is inclined. For example the stile extender may be used in combination with a ladder stabiliser such as is the subject of my UK Patent No. 2216168. As one possibility, one or two stile extenders may be attachable, preferably removably, to the ladder stabiliser. Most advantageously, the stile extender of the present invention may be used as a feature of the stabiliser which is the subject of my co-pending UK Patent Application No. 0008830.2. In that application, I have described a ladder stabiliser which comprises a rigid, generally flat base having a linear channel extending along a first, upper surface thereof, which channel is defined by a pair of generally parallel, upwardly extending channel side members having upper edges directed towards each other, and at least one ladder attachment by means of which a ladder stile may be extended downwardly. The ladder attachments may, for example, be two of the stile extenders according to the present invention.

When the stile extender of the present invention is used in combination with a rigid, generally flat base as described, the lower end of the downwardly-extending elongated member may carry a foot which is specifically shaped to match the cross-section of the linear channel formed on the base. For example, the channel may have an essentially circular cross-section and the stile extender foot may itself have such a circular cross-section; for example it may be spherical.

The invention will now be further described and illustrated with reference to the accompanying drawings, which illustrate, by way of example only, three preferred forms of the stile extender according to the present invention and wherein.

Figure 1:
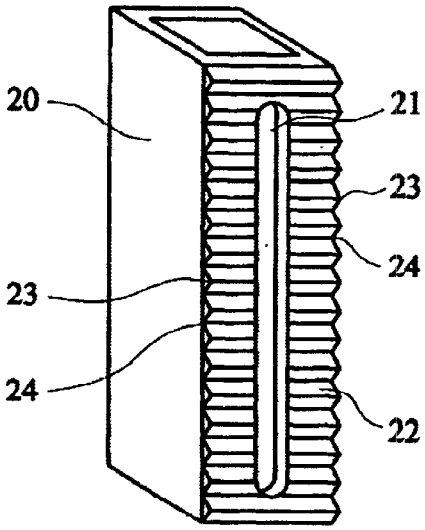
FIGS. 1 to 3 illustrate, in perspective view, the components of a first form of ladder stile extender according to the present invention.
Figure 3:
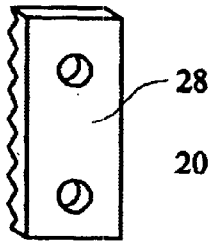
Figure 4:
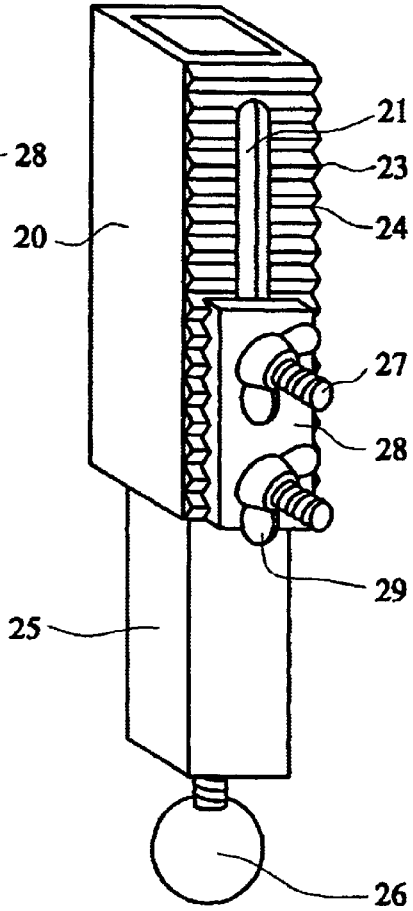
FIG. 4 illustrates, also in perspective view, this first form of ladder stile extender as assembled.
Figure 2:
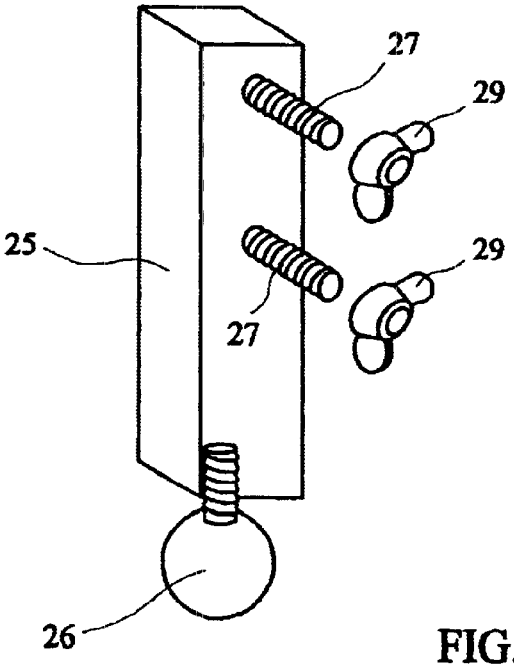

The ladder stile extender of FIGS. 1 to 4 comprises an elongated hollow member 20 of rectangular cross-section which has an elongated aperture 21 in its face 22. The face 22 is shaped with a succession of alternating angular ridges 23 and troughs 24. A solid inner member 25 is a close sliding fit within the hollow member 20 and carries a spherical foot 26 at its lower end.

Two bolts 27 project outwardly from the inner member 25 through the aperture 21. A locking member 28, which on its face towards the member 20 is shaped with ridges and troughs matching those on the face 22, may be secured against that face by means of wing nuts 29. By tightening these wing nuts in this way, the inner member 25 and hollow member 20 may be fixed together in a selected relative position in which the member 25 projects downwardly from the member 20 to the desired extent.

Figure 5:
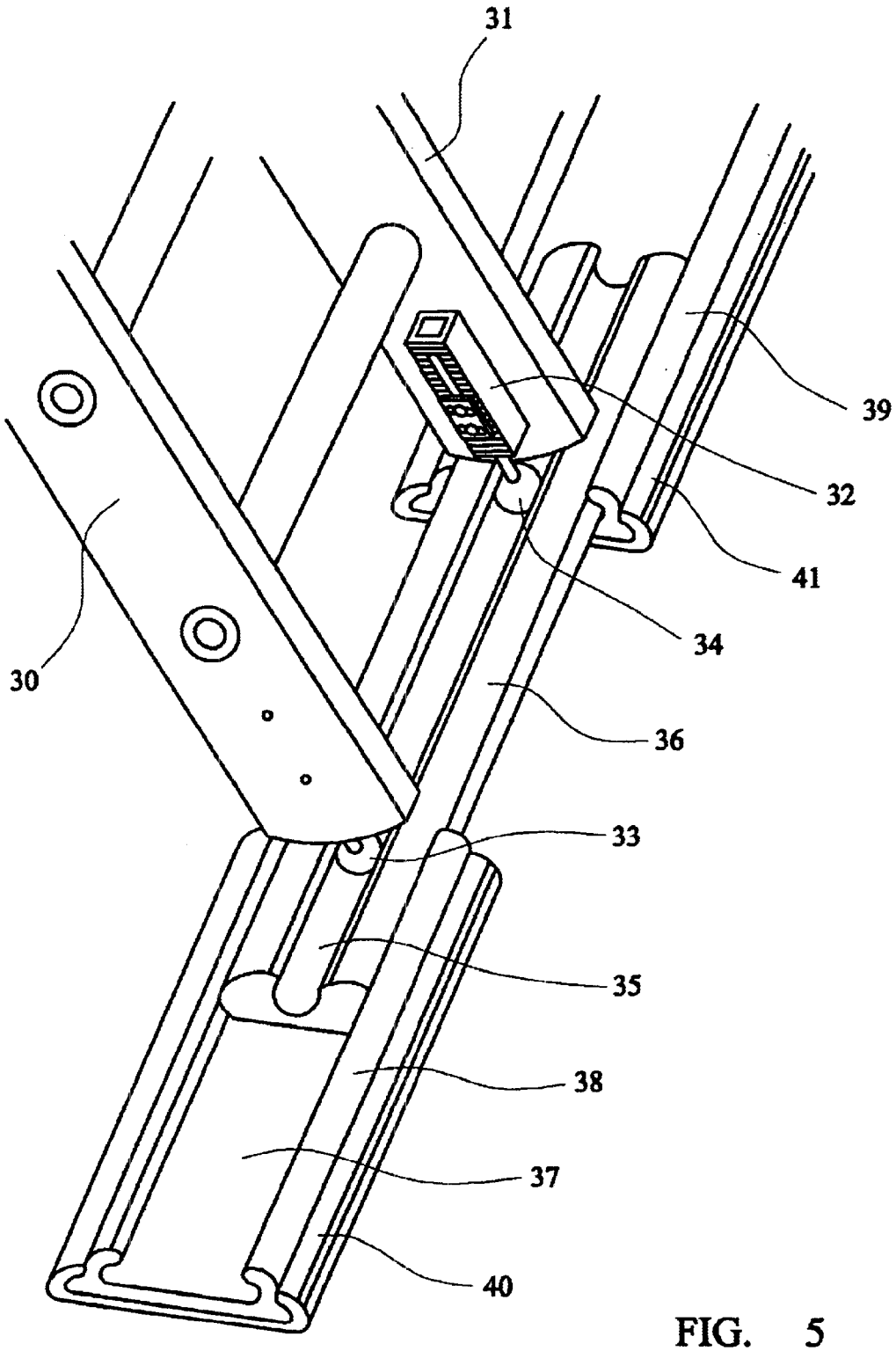
FIG. 5 illustrates, also in perspective view, a ladder stabiliser such as is the subject of my above co-pending application, incorporating two of the ladder stile extenders of FIGS. 1 to 4.

FIG. 5 shows two of the levelling supports of FIGS. 1 to 4 fitted to the two stiles 30, 31 of a ladder. The first levelling support is largely hidden by the ladder stile 30 but the levelling support 32 can be seen to be similar to that of FIG. 4. The respective inner members extend downwardly to different extents to compensate for inclination of the ground surface parallel to the plane of the ladder and the spherical feet 33, 34 both are a close sliding fit within an elongate channel 35, of part-circular cross-section, formed within an extruded aluminium channel member 36.

The channel member 36 is in turn mounted within an elongate channel 37 formed within two aligned extruded aluminium base parts 38 and 39. The base parts are each mounted upon a moulded rubber foot, 40 or 41, which has a profiled bottom surface. The base parts 38, 39 may be moved towards each other when the ladder stabiliser is to be transported or stowed but are spaced apart in use as illustrated, to provide additional lateral stability to the ladder. The whole stabiliser can readily be detached from the ladder by sliding the spherical feet 33, 34 linearly from either end of the channel 35 but otherwise remains loosely attached to the ladder when the ladder position is to be adjusted.

Figure 6:
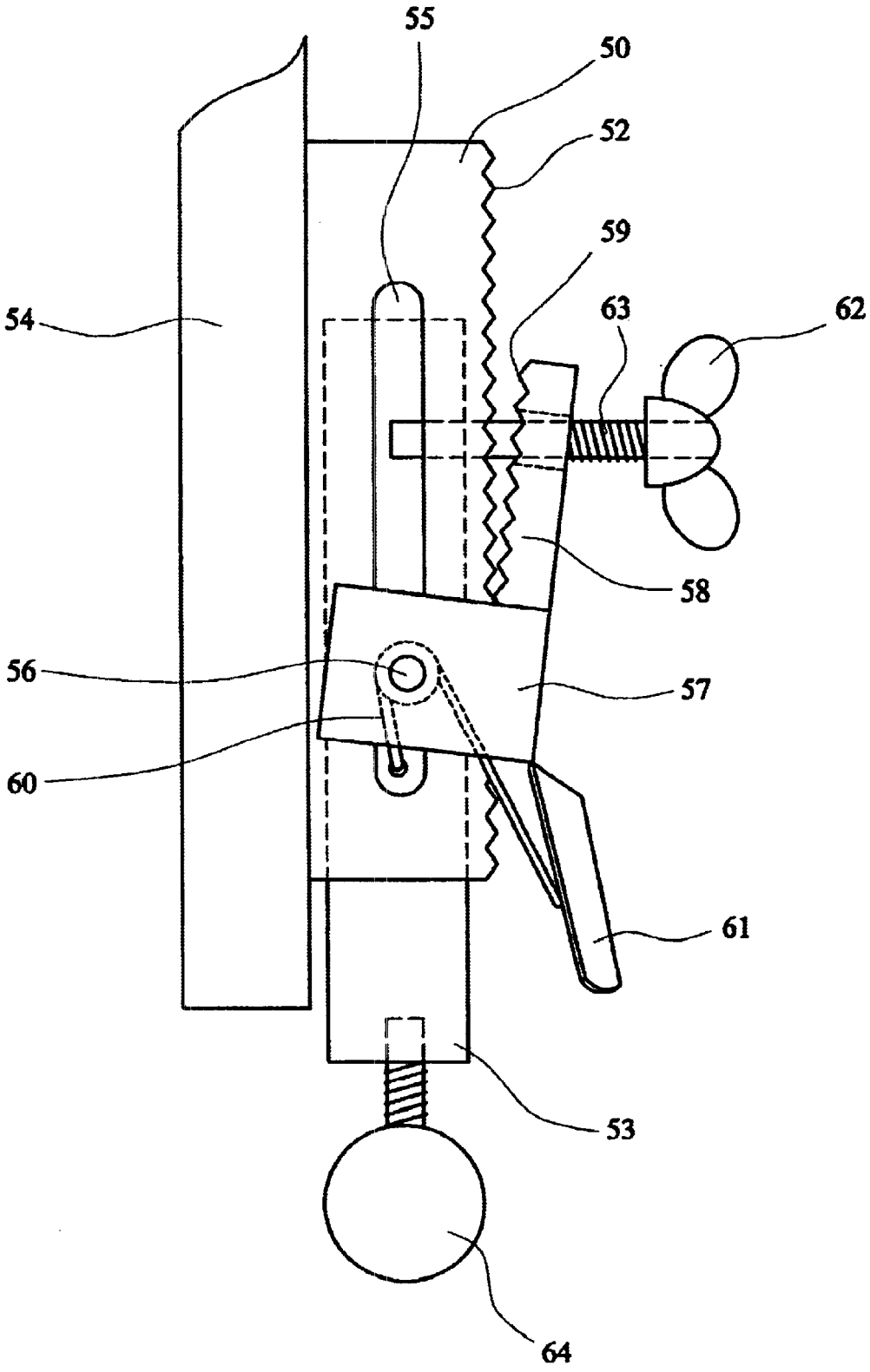
FIG. 6 is an elevation from one side of a second form of ladder stile extender according to the present invention in an open, fully extended condition and secured to a ladder stile.
Figure 7:
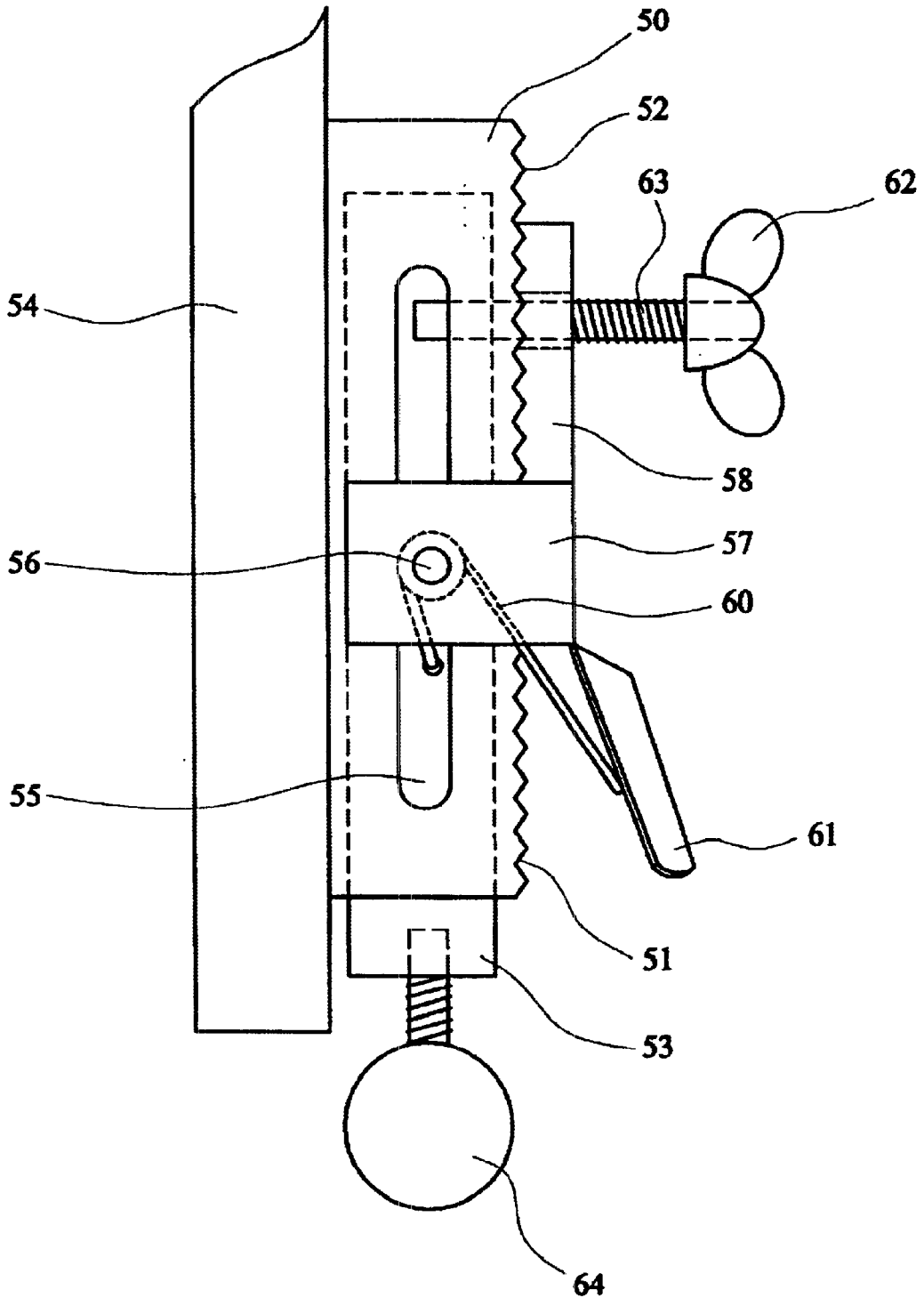
FIG. 7 is a view corresponding to FIG. 6 but with the extender in a closed and partly-retracted but unsecured condition.
Figure 8:
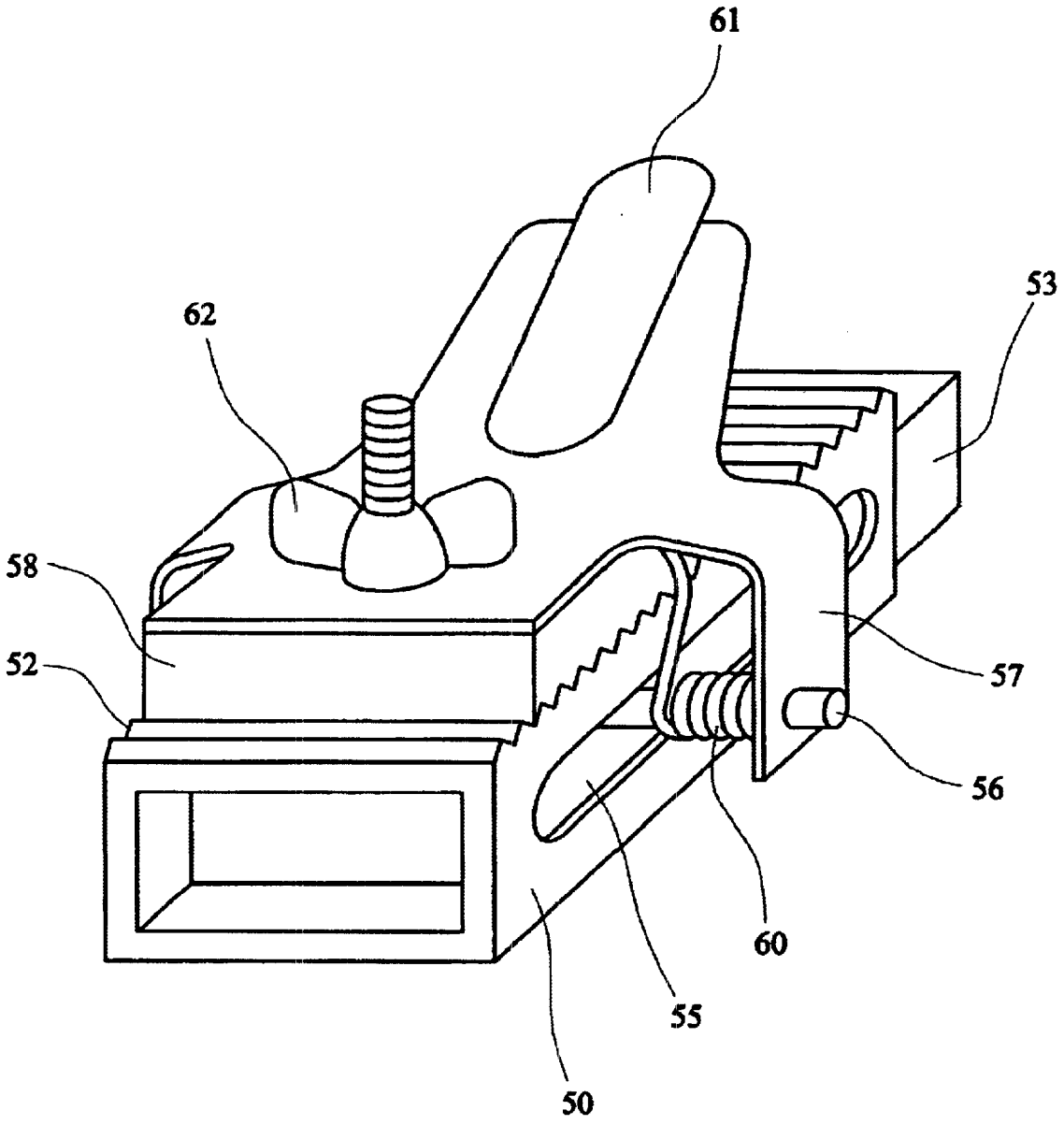
FIG. 8 is a perspective view of the stile extender of FIGS. 6 and 7, seen from its upper end.

The stile extender illustrated in FIGS. 6 to 8 comprises an elongated hollow member 50 of generally rectangular cross-section, the face 51 of which is shaped with a succession of alternating angular ridges and troughs together forming a continuous series of parallel teeth 52. A solid or hollow inner member 53 is of such dimensions as to be an easy sliding fit within the hollow member 50. The member 50 is secured by means not shown, for example by bolts, to the lower end of a ladder stile 54.

The hollow member 50 has an elongated aperture 55 in each of its two opposing sides and a linear pivot 56 extends between and through the apertures 55 and through the inner member 53. Upon its ends, the pivot 56 engages flanges 57 formed on a locking member 58, which is therefore able to swing about the pivot 56 into and out of contact with the member 50. The position of the pivot 56 is such that teeth 59 on the near face of the locking member 58 are thus able to engage and disengage the teeth 52 on the member 50.

A spiral spring 60 encircling the pivot 56 urges the member 58 to swing about the pivot into contact with the toothed face of the member 50 and for the teeth 52 and 59 to engage each other so as to prevent relative linear movement of the members 50 and 53. The two sets of teeth may in principle be disengaged by means of pressure, applied manually or by the user's foot, on a lever 61 formed on the locking member 58. In this way, the extent to which the member 53 projects downwardly from the member 50 may be increased or reduced as desired. However when that desired extent of projection has been achieved, then the two members are secured together by tightening of a wing nut 62 carried upon a screw 63 projecting from the member 53. At its lower end, the inner member 53 supports a spherical foot 64.

Thus when an illustrated stile extender is fitted to one of the stiles 54 of a ladder as described, the member 53 may be adjusted until it extends sufficiently to compensate for the inclination of the ground surface across the plane of the ladder. Of course two such extenders may be provided, one for each stile of the ladder, if desired, in particular when a ladder may need to be able to compensate for ground inclination in either of two opposing directions without reversing the ladder.

Figure 9:
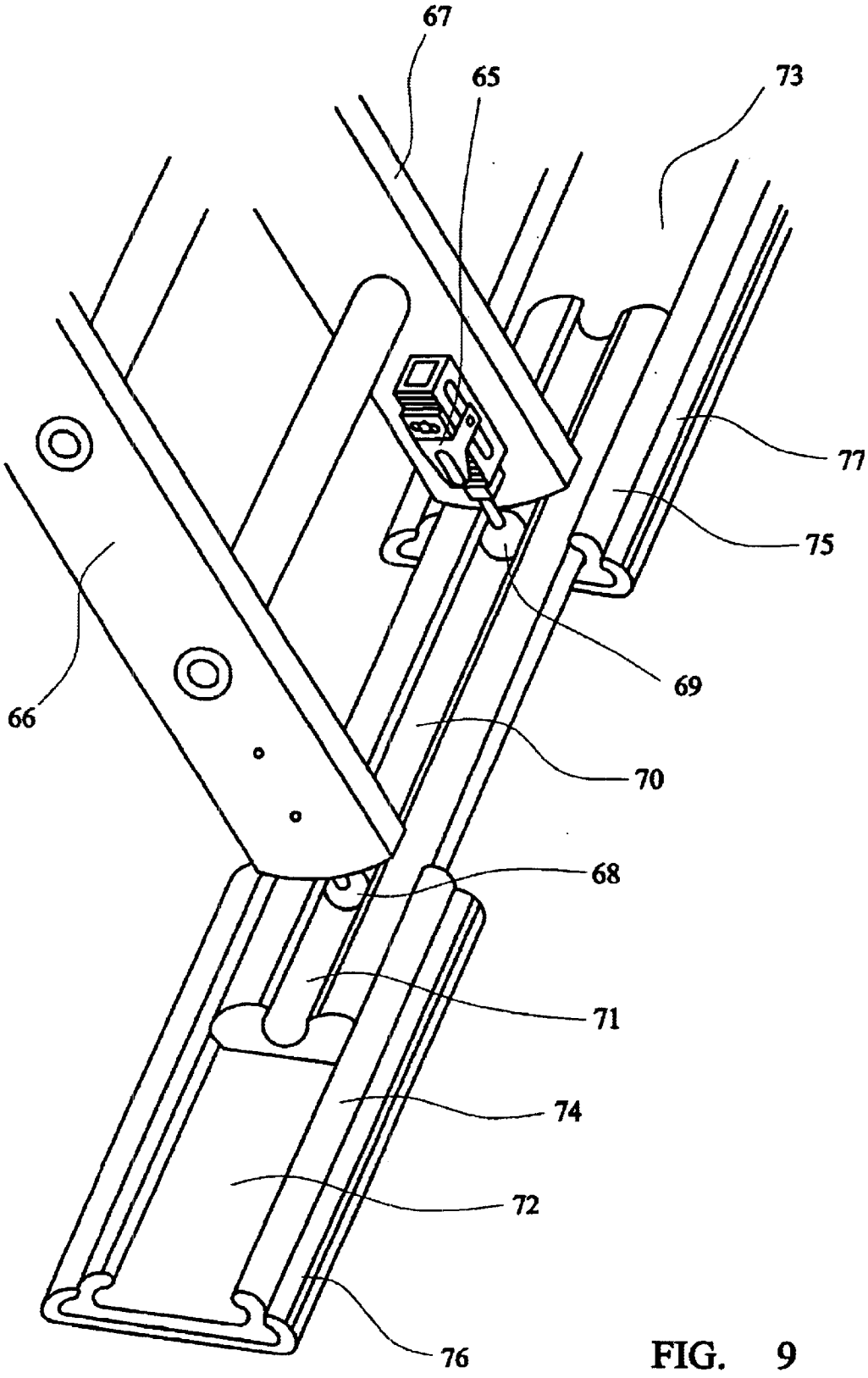
FIG. 9 is a perspective view showing a ladder stabiliser such as is the subject of my above co-pending application, incorporating two of the stile extenders of the type illustrated in FIGS. 6 to 8.

FIG. 9 illustrates, by way of example, the use of two stile extenders 65 according to the present invention, fitted to the inner faces of the two stiles 66 and 67 of a ladder. The feet 68 and 69 of the extenders are both spherical and they are each a sliding fit within a part-cylindrical channel 70 formed within an extruded channel member 71 which is a feature of a ladder stabiliser such as that according to my UK Patent Application No 0008830.2. The channel member 71 is in turn supported within channels 72 and 73 formed respectively in extruded base member parts 74 and 75. The base member parts are designed to be movable apart linearly to a limited extent, in order to form an extended base for the ladder. Each of these parts is in turn mounted upon a foot 76 or 77, formed in vulcanised moulded rubber and each having a profiled bottom surface to enhance the resistance to slippage of the ladder.

Figure 10:
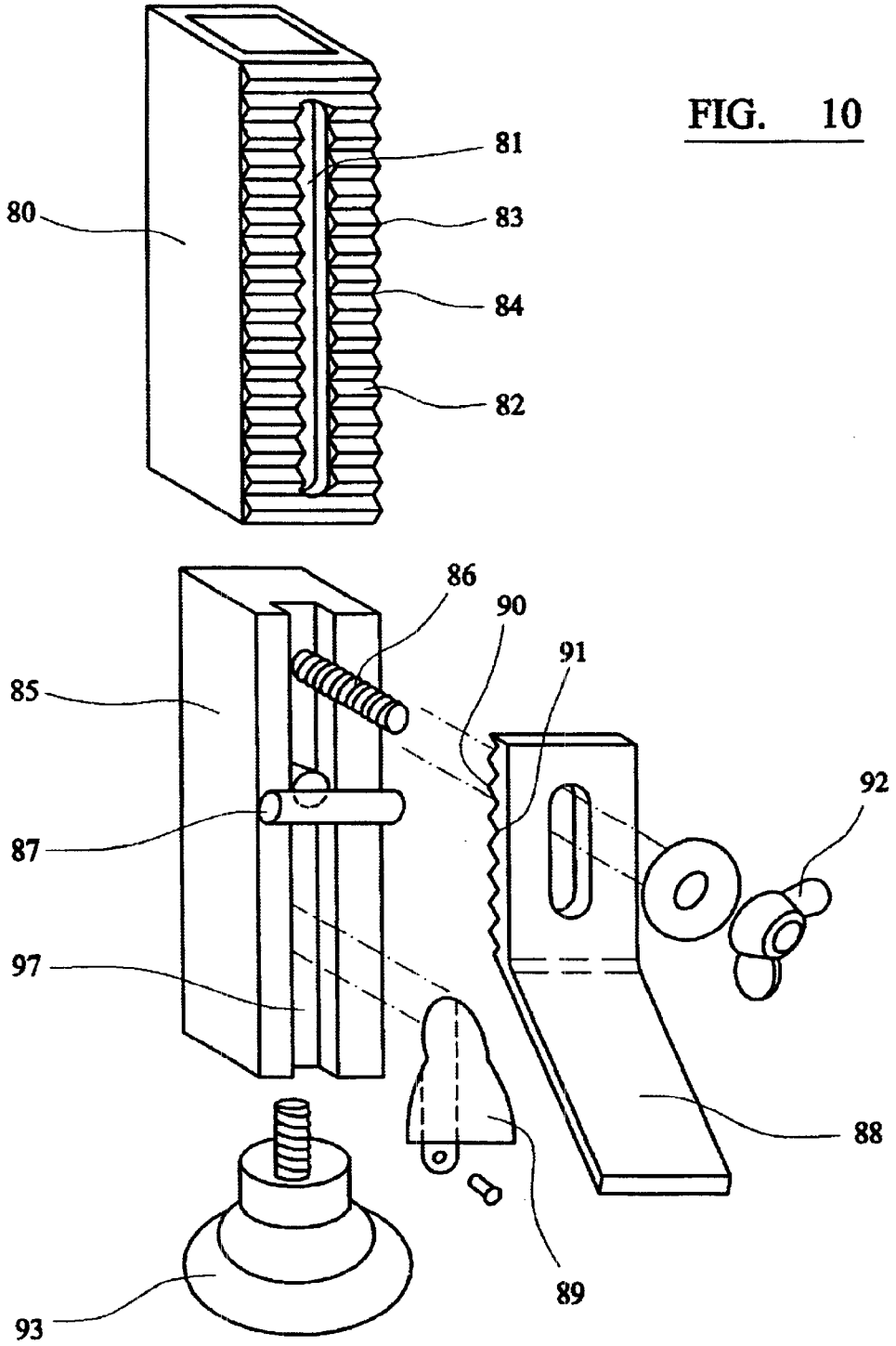
FIG. 10 is an exploded perspective view of a third, particularly preferred form of ladder stile extender according to the present invention.
Figure 11:
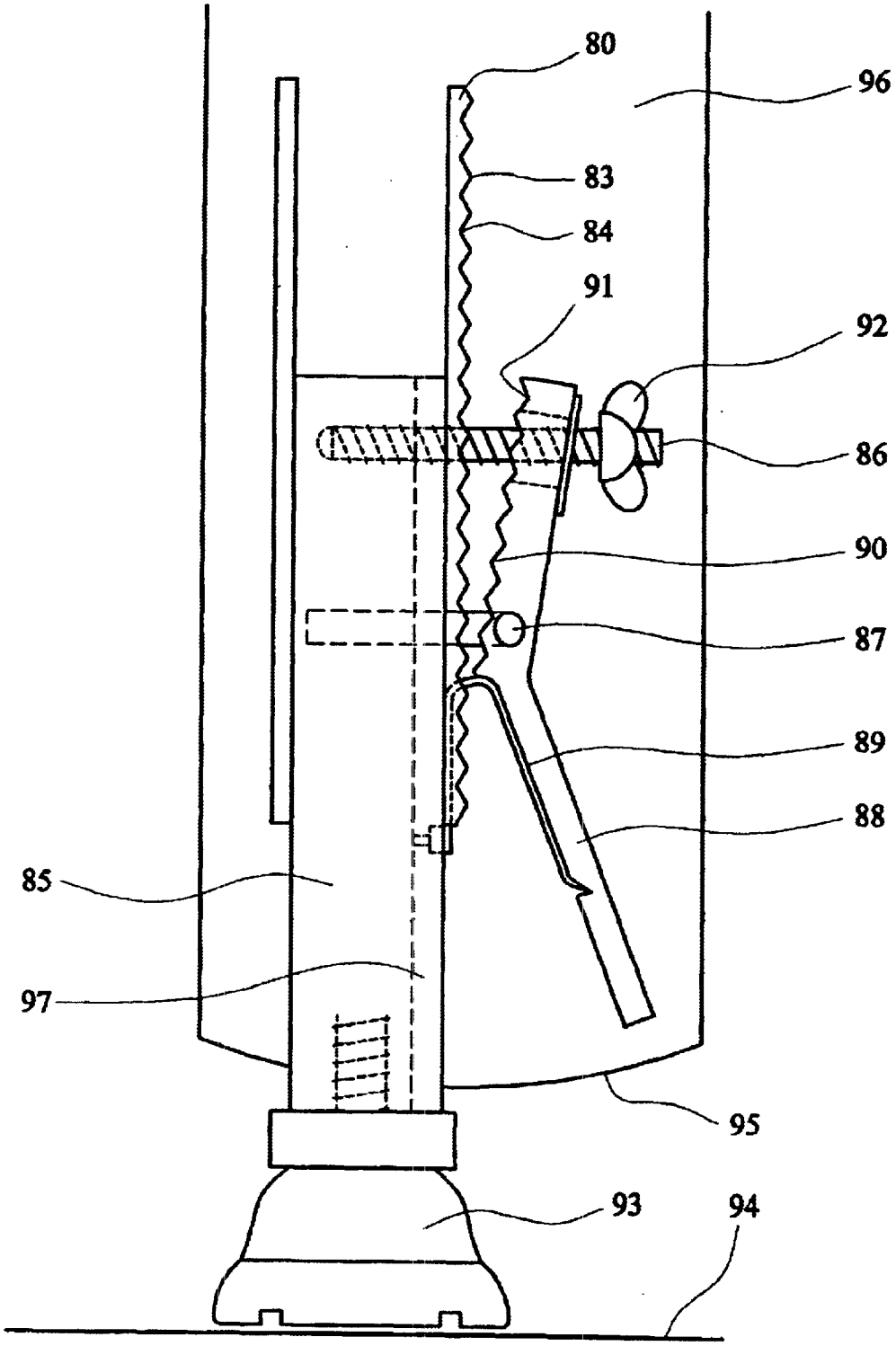
FIG. 11 is an elevation from one side of the stile extender of FIG. 10, assembled and in an open and extended condition.
Figure 12:
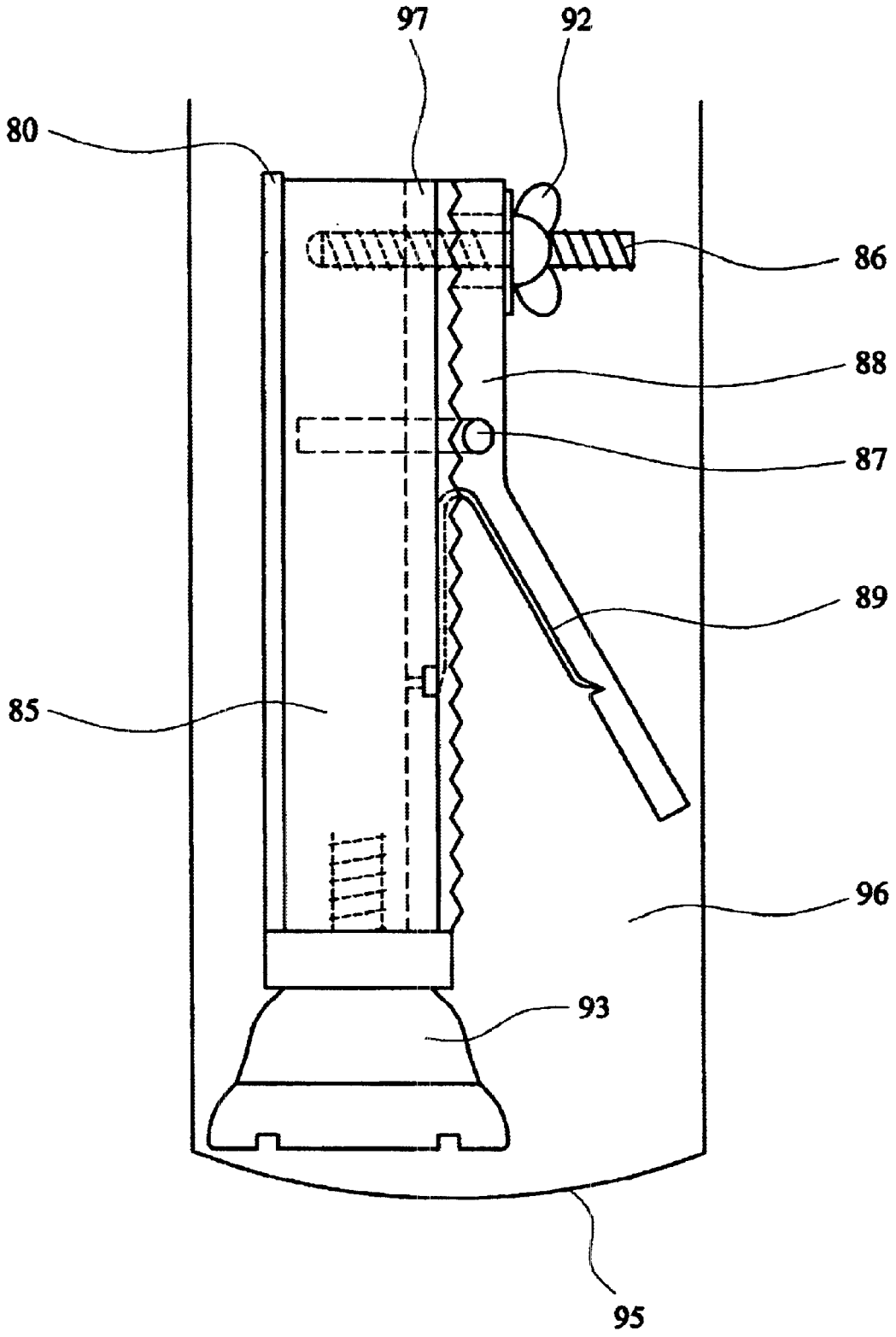
FIG. 12 is an elevation corresponding to FIG. 11 but with the stile extender in a closed and retracted condition.

The ladder stile extender illustrated in FIGS. 10 to 12 is of a particularly preferred and advantageous design. The illustrated extender comprises an elongated hollow member 80 of rectangular cross-section and having an elongated aperture 81 in its face 82. The face 82 is formed with a succession of alternating angular ridges 83 and troughs 84. A solid inner member 85 is a close sliding fit within the hollow member 80.

The inner member 85 carries a threaded bolt 86 which, when the ladder stile extender is assembled, projects through the aperture 81. Also carried by the inner member 85 and located on the outside of the aperture 81 is a T-bar 87 which forms a pivot for a saddle 88. The saddle 88 is urged about the pivot 87 by a spring 89 into a position in which parallel alternating angular ridges 90 and troughs 91 on the saddle 88 engage the troughs 84 and ridges 83 respectively. The bolt 86 and the supports for the pivot 87 and for the spring 89 are all located in a linear channel 97 in the front face of the inner member 85, thereby enhancing significantly the overall compactness of this form of stile extender and enabling it to be mounted wholly within the fore-and-aft depth of the ladder stile 96.

When, as illustrated in FIG. 11, a wing nut 92 on the bolt 86 is unscrewed sufficiently to allow the saddle 88 to pivot into a position in which the ridges 90 and trough 91 are disengaged from the troughs 84 and ridges 83, then the inner member 85, which carries a ground-engaging foot 93 pivoted upon its lower end, may be moved linearly within the hollow member 80 into engagement with the ground 94. In that position, tightening of the wing nut 92 brings the saddle 88 into locking engagement with the member 85, via the respective ridges and troughs, and maintains the extender in the selected extended position.

Subsequent unscrewing of the wing nut 92 allows the inner member 85 to be retracted until it no longer extends below the lower end 95 of the ladder stile 96, as illustrated in FIG. 12.

While each of the ladder stile extenders illustrated by way of example in the accompanying drawings represents an effective means of extending the relevant ladder stile simply, securely and effectively as required, the extender illustrated in FIGS. 8 to 10 combines the important advantage of simplicity of operation with a design that may very readily be manufactured in quantity at a reasonable cost, thereby enhancing the likelihood of its being purchased and installed in all situations of potential instability of a ladder attributable to transverse ground slope.

The ladder stile extender according to the present invention, in particular in its illustrated forms, may advantageously be attached to the stile of any conventional ladder, including such ladders in which the stiles are of wood or of metal. However it is also possible, and in many situations, to provide either one or two of these stile extenders as a unit already attached to, and even built into the design of, a ladder as actually sold. In this way, not only is any minor inconvenience of actually fitting the extender to a ladder avoided, it also enhances the likelihood of its adoption in marginal situations wherein the user might otherwise take the risk of using a ladder on a laterally inclined surface without adequate safeguard.

What is claimed is:

1. A ladder stile extender comprising two elongated members one of which is slidable within the other and having means for securing one of said members to a ladder stile having an external surface and the other of the said members functioning as a stile extender or having means to secure it to a stile extension, a set of generally parallel irregularities associated with each of said members for interengagement, said ladder stile extender being characterised by means for moving the two sets of irregularities into and out of engagement with each other by relative pivoting of said two sets, wherein one said set of irregularities is fixed to one of said elongated members and the other said set of irregularities is pivotally attached to the other of said elongated members, and a spring biasing the said two sets of irregularities into engagement and locking means comprising a fastener extending transversely through said two sets of irregularities to secure said members together with said sets of irregularities so engaged, such that the two sets of irregularities cannot undergo relative pivoting.

2. A ladder stile extender as claimed in claim 1, wherein the outer of said two elongated members includes a securement surface for securance to said ladder stile.

3. A ladder stile extender as claimed in claim 1, wherein the outer of said two elongated members include a securement surface for securance to the external surface of said ladder stile.

4. A ladder stile extender as claimed in claim 1 having an unextended length of the order of 6 or 7 inches (15.24 to 17.78 cm).

5. A ladder stile extender as claimed in claim 1, wherein said two elongated members are of rectangular, including square, cross-section.

6. A ladder stile extender as claimed in claim 1, wherein there are fewer of said generally parallel irregularities associated with one of the mutually slidable members than on the other said member, as counted in the direction of relative movement of said members.

7. A ladder stile extender as claimed in claim 6, wherein said fewer generally parallel irregularities are associated with the one member that is slidable within the other said member.

8. A ladder stile extender as claimed in claim 1, wherein a relatively shorter movable member carrying a relatively smaller number of transverse irregularities is pivoted relative to a longer member having a larger number of said transverse irregularities and is urged into a position wherein said two sets of irregularities are interengaged by means of said spring.

9. A ladder stile extender as claimed in claim 1, wherein said fastener comprises a threaded bolt, or a nut or wing-nut threaded upon a threaded bolt.

10. A ladder stile extender as claimed in claim 1, wherein the lower end of the extending member or associated stile extension is adapted for stable engagement with the ground surface or with a ladder base stabiliser of the type which prevents slippage of a ladder away from a wall.

11. A ladder stile extender as claimed in claim 10, wherein said extending member or associated stile extension carries a ground-engaging foot.

12. A ladder stile extender as claimed in claim 11, wherein said ground-engaging foot is pivoted upon said extending member or extension.

* * * * *